US007150299B2

(12) United States Patent
Hertzler et al.

(10) Patent No.: US 7,150,299 B2
(45) Date of Patent: Dec. 19, 2006

(54) ASSEMBLY AND METHOD FOR CONTAINING, RECEIVING AND STORING FLUIDS AND FOR DISPENSING GAS FROM A FLUID CONTROL AND GAS DELIVERY ASSEMBLY HAVING AN INTEGRATED FLUID FLOW RESTRICTOR

(75) Inventors: Benjamin Lee Hertzler, Allentown, PA (US); Robert Harrison Shay, Allentown, PA (US); Alexandre de Almeida Botelho, Bethlehem, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 161 days.

(21) Appl. No.: 10/661,267

(22) Filed: Sep. 12, 2003

(65) Prior Publication Data

US 2005/0056338 A1 Mar. 17, 2005

(51) Int. Cl.
*B65B 1/30* (2006.01)

(52) U.S. Cl. ..... 141/94; 141/2; 141/18; 141/51; 141/302; 137/597

(58) Field of Classification Search ..... 141/2–7, 141/18, 40, 47, 51, 94, 192, 198, 302; 137/240, 137/597, 884
See application file for complete search history.

(56) References Cited

U.S. PATENT DOCUMENTS

| | | | | |
|---|---|---|---|---|
| 255,338 | A | 3/1882 | Salomon | |
| 788,352 | A | 4/1905 | Crawford | |
| 1,042,745 | A | 10/1912 | Zahm | |
| 1,731,519 | A | 10/1929 | Bastian | |
| 1,837,233 | A | 12/1931 | Rumpff | |
| 1,916,635 | A | 7/1933 | Pepper | |
| 2,057,150 | A | 10/1936 | Kehl et al. | 50/23 |
| 2,091,051 | A | 8/1937 | Mesinger | 50/23 |
| 2,105,864 | A | 1/1938 | Saunders | 251/31 |
| 2,237,052 | A | 4/1941 | Gill | 62/1 |
| 2,322,468 | A | 6/1943 | Redrup | 50/35 |

(Continued)

FOREIGN PATENT DOCUMENTS

| | | |
|---|---|---|
| CS | 250347 | 9/1986 |

(Continued)

OTHER PUBLICATIONS

George et al., "Minimizing System contamination potential from gas handling", *Semiconductor International*, pp. 98-104, Jul. 1993.

(Continued)

*Primary Examiner*—Timothy L. Maust
(74) *Attorney, Agent, or Firm*—McAndrews, Held & Malloy Ltd.

(57) ABSTRACT

A fluid control and gas delivery assembly and method for containing, receiving and storing hazardous fluids and for dispensing gas comprising a container, a fluid fill path, a gas dispensing path, a first shut-off valve, a pressure reducer, a fluid flow restrictor, a second shut-off valve and a fluid outlet connector. The first shut-off valve is positioned in said gas dispensing path upstream of a pressure reducer. A fluid flow restrictor downstream of the pressure reducer has a fluid flow restriction path configured to restrict the flow of the fluid delivered to the fluid flow restrictor at the delivery pressure to a maximum mass flow rate that is equal to or less than the allowable mass flow rate standard for the hazardous fluid. The second shut-off valve is positioned in said gas dispensing path downstream of said pressure reducer.

21 Claims, 6 Drawing Sheets

U.S. PATENT DOCUMENTS

| | | | | |
|---|---|---|---|---|
| 2,357,777 | A | 9/1944 | White | 62/1 |
| 2,499,527 | A | 3/1950 | Raymond | 137/53 |
| 2,502,588 | A | 4/1950 | Preston et al. | 62/1 |
| 2,509,078 | A | 5/1950 | Stover | 73/205 |
| 2,517,534 | A | 8/1950 | Courtot | 50/23 |
| 2,608,971 | A | 9/1952 | Holmes | 128/142 |
| 2,623,331 | A | 12/1952 | Greening | 50/14 |
| 2,645,884 | A | 7/1953 | Kellie | 50/10 |
| 2,654,976 | A | 10/1953 | Jörgensen | 50/21 |
| 2,666,297 | A | 1/1954 | Skousgaard | 251/123 |
| 2,675,793 | A | 4/1954 | Ziege | 123/121 |
| 2,693,823 | A | 11/1954 | Sogge | 137/614.21 |
| 2,750,071 | A | 6/1956 | Ritchie | 222/3 |
| 2,765,983 | A | 10/1956 | Mayo | 236/34 |
| 2,854,991 | A | 10/1958 | Webster | 137/322 |
| 2,861,587 | A | 11/1958 | Hursen | 137/494 |
| 2,918,930 | A | 12/1959 | Jansen | 137/81 |
| 2,925,987 | A | 2/1960 | Priesmeyer | 251/61 |
| 3,083,721 | A | 4/1963 | Matthews et al. | 137/63 |
| 3,095,890 | A | 7/1963 | Cousteau et al. | 137/63 |
| 3,137,308 | A | 6/1964 | Machlanski et al. | 137/63 |
| 3,212,525 | A | 10/1965 | Henderson | 137/625.4 |
| 3,214,134 | A | 10/1965 | Noakes | 251/282 |
| 3,245,583 | A | 4/1966 | Miller et al. | 222/52 |
| 3,276,470 | A | 10/1966 | Griffing | 137/505.15 |
| 3,319,649 | A | 5/1967 | Cummins | 137/505.18 |
| 3,566,913 | A | 3/1971 | Parthe, Jr. | 137/493 |
| 3,650,290 | A | 3/1972 | Moen et al. | 137/339 |
| 3,709,242 | A | 1/1973 | Chase | 137/81 |
| 3,720,222 | A | 3/1973 | Andrews et al. | 137/154 |
| 3,746,036 | A | 7/1973 | Du Bois et al. | 137/496 |
| 3,756,271 | A | 9/1973 | Gorgono et al. | 137/494 |
| 3,766,933 | A | 10/1973 | Nicholson, Jr. | 137/116.3 |
| 3,776,267 | A | 12/1973 | Alley | 137/494 |
| 3,787,023 | A | 1/1974 | Shufflebarger et al. | 251/335 B |
| 3,797,803 | A | 3/1974 | Goto et al. | 251/61.5 |
| 3,811,467 | A | 5/1974 | Jones | 137/494 |
| 3,827,246 | A | 8/1974 | Moen et al. | 62/50 |
| 3,845,876 | A | 11/1974 | Needham et al. | 220/203 |
| 3,939,872 | A | 2/1976 | Wentworth, Jr. | 138/31 |
| 3,955,794 | A | 5/1976 | Hankosky | 251/123 |
| 3,982,559 | A | 9/1976 | Ochs | 137/455 |
| 4,004,608 | A | 1/1977 | Kish | 137/510 |
| 4,040,445 | A | 8/1977 | McCormick | 137/596.18 |
| 4,044,737 | A | 8/1977 | Nishimura | 123/119 |
| 4,044,739 | A | 8/1977 | Miura et al. | 123/119 A |
| 4,061,483 | A | 12/1977 | Burg | 62/268 |
| 4,070,001 | A | 1/1978 | Musgrove | 251/46 |
| 4,108,197 | A | 8/1978 | Brakebill | 137/81 |
| 4,120,480 | A | 10/1978 | Ando et al. | 251/61.5 |
| 4,128,391 | A | 12/1978 | Braunstein | 431/354 |
| 4,166,607 | A | 9/1979 | Webb | 251/335 B |
| 4,167,198 | A | 9/1979 | Kotyza et al. | 137/528 |
| 4,198,854 | A | 4/1980 | Washington et al. | 73/38 |
| 4,201,366 | A | 5/1980 | Danko et al. | 251/335 B |
| 4,211,387 | A | 7/1980 | Getchell et al. | 251/335 B |
| 4,228,777 | A | 10/1980 | Haase | 123/454 |
| 4,232,695 | A | 11/1980 | Roberge | 137/1 |
| 4,237,920 | A | 12/1980 | Norman | 137/243.3 |
| 4,287,909 | A | 9/1981 | Tompson | 137/312 |
| 4,335,742 | A | 6/1982 | Jacyno | 137/494 |
| 4,348,005 | A | 9/1982 | Eaton et al. | 251/268 |
| 4,349,136 | A | 9/1982 | Fallon et al. | 222/396 |
| 4,376,376 | A | 3/1983 | Gregory | 62/51 |
| 4,431,117 | A | 2/1984 | Genbauffe et al. | 222/3 |
| 4,434,778 | A | 3/1984 | Morita et al. | 123/587 |
| 4,484,695 | A | 11/1984 | Fallon et al. | 222/23 |
| 4,487,334 | A | 12/1984 | Werding | 222/55 |
| 4,497,339 | A | 2/1985 | Gruner et al. | 137/495 |
| 4,508,132 | A | 4/1985 | Mayfield, Jr. et al. | 137/62 |
| 4,520,838 | A | 6/1985 | Fisher et al. | 137/69 |
| 4,526,341 | A | 7/1985 | Thomas | 251/63.5 |
| 4,537,385 | A | 8/1985 | Bragg et al. | 251/214 |
| 4,556,193 | A | 12/1985 | Yoshiga | 251/129.11 |
| 4,583,372 | A | 4/1986 | Egan et al. | 62/53 |
| 4,606,195 | A | 8/1986 | Winkler | 62/45 |
| 4,634,099 | A | 1/1987 | Danko et al. | 251/335.3 |
| 4,640,221 | A | 2/1987 | Barbee et al. | 118/689 |
| 4,659,061 | A | 4/1987 | Scheffel | 251/332 |
| 4,662,393 | A | 5/1987 | Genbauffe et al. | |
| 4,687,017 | A | 8/1987 | Danko et al. | 137/315 |
| 4,702,277 | A | 10/1987 | Ollivier | 137/613 |
| 4,706,929 | A | 11/1987 | Kalaskie et al. | 251/14 |
| 4,709,575 | A | 12/1987 | Myers | 73/23 |
| 4,723,967 | A | 2/1988 | Tom | 55/36 |
| 4,738,693 | A | 4/1988 | Tom | 55/36 |
| 4,754,897 | A | 7/1988 | Brace | 222/402 |
| 4,756,310 | A | 7/1988 | Bitterly | 128/400 |
| 4,763,690 | A | 8/1988 | Martin | 137/613 |
| 4,815,699 | A | 3/1989 | Mueller | 251/129.11 |
| 4,821,907 | A | 4/1989 | Castles et al. | 220/5 |
| 4,828,219 | A | 5/1989 | Ohmi et al. | 251/118 |
| 4,844,111 | A | 7/1989 | Pritchard et al. | 137/71 |
| 4,846,440 | A | 7/1989 | Carlson et al. | 251/129.17 |
| 4,905,723 | A | 3/1990 | Pritchard et al. | 137/71 |
| 4,909,269 | A | 3/1990 | Pritchard et al. | 137/71 |
| 4,917,136 | A | 4/1990 | Ohmi et al. | 137/15 |
| 5,056,759 | A | 10/1991 | Schlesch | 251/330 |
| 5,071,453 | A | 12/1991 | Hradek et al. | 55/21 |
| 5,086,801 | A | 2/1992 | Peacock et al. | 137/12 |
| 5,117,797 | A | 6/1992 | Telep et al. | 123/520 |
| 5,131,627 | A | 7/1992 | Kolenc | 251/331 |
| 5,156,827 | A | 10/1992 | Tom et al. | 423/299 |
| 5,165,655 | A | 11/1992 | Drexel et al. | 251/129.02 |
| 5,209,253 | A | 5/1993 | Taylor | 137/67 |
| 5,217,043 | A | 6/1993 | Novakovic | 137/460 |
| 5,238,016 | A | 8/1993 | Eidsmore | 137/1 |
| 5,238,024 | A | 8/1993 | Taylor | 137/613 |
| 5,255,525 | A | 10/1993 | Wieland et al. | 62/46.1 |
| 5,263,477 | A | 11/1993 | Crome | 128/205.24 |
| 5,271,232 | A | 12/1993 | Ogawa et al. | 62/50.1 |
| 5,297,578 | A | 3/1994 | Scott et al. | 13/510 |
| 5,305,791 | A | 4/1994 | Kowalchuk | 137/613 |
| 5,329,966 | A | 7/1994 | Fenimore et al. | 137/613 |
| 5,337,790 | A | 8/1994 | Heritier-Best et al. | 251/129.21 |
| 5,341,968 | A | 8/1994 | Vandoninck | 222/396 |
| 5,357,758 | A | 10/1994 | Andonian | 62/45.1 |
| 5,390,697 | A | 2/1995 | Muschelknautz | 137/494 |
| 5,392,815 | A | 2/1995 | Stuart | 138/37 |
| 5,398,725 | A | 3/1995 | Nakazawa et al. | 137/636.1 |
| 5,421,366 | A | 6/1995 | Naffziger et al. | 137/614.2 |
| 5,438,837 | A | 8/1995 | Caldwell et al. | 62/50.1 |
| 5,442,927 | A | 8/1995 | Germain | 62/50.2 |
| 5,443,090 | A | 8/1995 | Ligh | 137/489 |
| 5,452,738 | A | 9/1995 | Borland et al. | 137/265 |
| 5,456,281 | A | 10/1995 | Teay | 137/505.12 |
| 5,456,445 | A | 10/1995 | Griffin | |
| 5,544,785 | A | 8/1996 | Frigiere | 222/3 |
| 5,553,635 | A | 9/1996 | Gregoire | 137/1 |
| 5,597,009 | A | 1/1997 | Scherrer et al. | 137/375 |
| 5,601,107 | A | 2/1997 | Moore et al. | 137/15 |
| 5,634,627 | A | 6/1997 | Daido et al. | 251/335.3 |
| 5,651,528 | A | 7/1997 | Frei et al. | 251/54 |
| 5,673,897 | A | 10/1997 | Crochet et al. | 251/63.6 |
| 5,678,803 | A | 10/1997 | Shinohara et al. | 251/368 |
| 5,740,833 | A | 4/1998 | Olds et al. | 137/505.12 |
| 5,749,227 | A | 5/1998 | Smith et al. | 60/657 |
| 5,755,254 | A | 5/1998 | Carter et al. | 137/340 |
| 5,755,255 | A | 5/1998 | Iwabuchi | 137/341 |
| 5,755,364 | A | 5/1998 | LeCoffre et al. | 222/564 |
| 5,761,910 | A | 6/1998 | Tom | 62/46.1 |
| 5,819,782 | A | 10/1998 | Itafuji | 137/240 |
| 5,820,102 | A | 10/1998 | Borland | 251/144 |
| 5,836,351 | A | 11/1998 | Underwood, III | 137/587 |

| | | | | |
|---|---|---|---|---|
| 5,845,675 | A | 12/1998 | Ligh | 137/489 |
| 5,890,876 | A | 4/1999 | Suito et al. | 417/213 |
| 5,895,376 | A | 4/1999 | Schwartz et al. | 604/256 |
| 5,909,747 | A | 6/1999 | Schieber | 137/492 |
| 5,913,505 | A | 6/1999 | Ouvrard | 251/303 |
| 5,915,410 | A | 6/1999 | Zajac | 137/234.1 |
| 5,916,245 | A | 6/1999 | Tom | 62/46.1 |
| 5,935,305 | A | 8/1999 | Tom et al. | 96/143 |
| 5,941,506 | A | 8/1999 | Smith et al. | 251/335.3 |
| 5,964,446 | A | 10/1999 | Walton et al. | 251/127 |
| 5,996,617 | A | 12/1999 | Olds et al. | 137/505.46 |
| 6,000,419 | A | 12/1999 | Bernhard | 137/15 |
| 6,003,535 | A | 12/1999 | Ollivier | 137/15 |
| 6,007,609 | A | 12/1999 | Semerdjian et al. | 96/108 |
| 6,101,816 | A | 8/2000 | Wang et al. | 62/48.1 |
| 6,155,289 | A | 12/2000 | Carlsen et al. | |
| 6,186,177 | B1 | 2/2001 | Maher | 137/884 |
| 6,210,482 | B1 | 4/2001 | Kitayama et al. | 118/715 |
| 6,216,739 | B1 | 4/2001 | Fukushima et al. | 137/884 |
| 6,314,986 | B1 | 11/2001 | Zheng et al. | 137/240 |
| 2002/0124883 | A1 | 9/2002 | Zheng, et al. | |
| 2004/0050326 | A1* | 3/2004 | Thilderkvist et al. | 118/715 |

FOREIGN PATENT DOCUMENTS

| | | |
|---|---|---|
| EP | 0 512 553 | 11/1992 |
| EP | 0 470 009 | 2/1995 |
| GB | 743011 | 1/1956 |
| GB | 1215303 | 12/1970 |
| GB | 1430213 | 3/1976 |
| GB | 2 045 414 | 10/1980 |
| JP | 57-207913 | 12/1982 |
| JP | 61-266884 | 11/1986 |
| WO | WO 94/17334 | 8/1994 |
| WO | WO 00/79159 | 6/2000 |
| WO | WO 00/67089 | 11/2000 |
| WO | WO 2001 083082 | 11/2001 |
| WO | WO 2003 103862 | 12/2003 |

OTHER PUBLICATIONS

Fine et al., "Design and Operation of UHP Low Vapor Pressure and Reactive Gas Delivery Systems", *Semiconductor International*, pp. 138-143, Oct. 1995.

Pierce et al., "Safe Usage of C1F3: Supply, vacuum service, and exhaust gas management", *Solid State Technology*, vol. 40, Issue 9, Sep. 1997.

Olander et al., "Reducing the HPM Risk: Pressure-actuated Gas Delivery", *Semiconductor Fabtech*, 12th Edition.

Olander, "Gas Packaging: A Roadmap To Reduced Risk And Higher Productivity", *SESHA Journal*, vol. 15#3/4 pp. 9-15.

Semi™, "Semi S5-93 Safety Guideline for Flow Limiting Devices", Semi 1993.

Semi™, "Semi S5-0703 Safety Guideline for Sizing and Identifying Flow Limiting Devices for Gas Cylinder Valves", Semi 1993, 2003.

Unpublished European search report for Application No. 04021232.6 - 2425, dated Jun. 14, 2006.

* cited by examiner

ASSEMBLY AND METHOD FOR CONTAINING, RECEIVING AND STORING FLUIDS AND FOR DISPENSING GAS FROM A FLUID CONTROL AND GAS DELIVERY ASSEMBLY HAVING AN INTEGRATED FLUID FLOW RESTRICTOR

CROSS-REFERENCE TO RELATED APPLICATIONS

Not presently applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING SUBMITTED ON A COMPACT DISK

Not applicable.

FIELD OF THE INVENTION

The present invention generally relates to a fluid control and gas delivery assembly for containing, receiving and storing fluids and for dispensing gas from a fluid container, vessel or tank ("fluid container"). In particular, the present invention employs a fluid control and gas delivery assembly having an integrated fluid flow restrictor. The present invention further relates to a method of control and delivery of fluid from such a fluid control and gas delivery assembly.

BACKGROUND OF THE INVENTION

Control and delivery of high purity corrosive, toxic, oxidant, inert, pyrophoric fluids and mixtures of such fluids from fluid containers is necessary to a wide range of processing and manufacturing markets, such as in the medical and semiconductor industries. Use of such fluids can be hazardous, unless they are handled carefully.

An uncontrolled release of hazardous fluids is particularly undesirable for safety and toxicity reasons. Such a release can lead to catastrophic consequences, including injury and even death to persons working in the area where the fluid release occurs. In addition, in many industrial applications, any such release would also necessitate a partial or complete evacuation of, at least, the industrial facility in the area where the uncontrolled release occurred, resulting in substantial economic losses. An uncontrolled release also has the potential to cause costly damage to sensitive and expensive equipment exposed to such hazardous fluid, because many of these fluids are corrosive.

One type of arrangement for controlling hazardous fluids consists of a number of discrete components fitted to the outside of the fluid container valve to control such functions as pressure, flow, gas shut-off, and safety relief. Such an arrangement has numerous joints that are often prone to leakage, resulting in difficulty controlling the quality and purity of the fluid for the user's application. Often, at least some portion of such an arrangement must be enclosed in a gas cabinet. A gas cabinet is large and expensive. These prior arrangements utilizing discrete components, with their associated problems, are undesirable, particularly in processing and manufacturing applications where high purity corrosive, toxic, oxidant, inert, pyrophoric fluids and mixtures of such fluids are utilized, such as in the medical and semiconductor industries.

Another type of fluid control arrangement has been recently developed that can be used for, among other things, controlling hazardous fluids, and is disclosed by U.S. Pat. No. 6,314,986 B1 ("'986 patent"). The '986 patent is assigned to the assignee of the present invention, Air Products and Chemicals, Inc. As more particularly pointed out in the '986 patent, rather than just connecting a number of discrete components into a control panel system, which has also been proposed in some miniaturized gas control systems, the '986 patent encompasses redesigning and machining a group of components directly into a discrete body (referred to as a module), or onto an electronic chip (for example, in micro-electro-mechanical system units), such that a number of modules can be interconnected to meet various user and market needs.

The '986 patent discloses, among other things, building functions into the discrete body or module that can give users added benefits, such as direct pressure control and flow control, which may further permit the complete elimination of the gas cabinet. In addition, in the high technology, high cost markets, such as electronics, the '986 patent overcomes the problems associated with corrosion, contamination, and human exposure when making and breaking connections to the fluid container, especially when using high purity corrosive, toxic, oxidant, inert, or pyrophoric fluids and mixtures of such fluids.

Typically, these prior flow control arrangements have further employed fluid flow restrictors, such as restrictive flow orifices and capillary tubes, in view of the serious consequences that can result from an uncontrolled release of hazardous fluids. Fluid flow restrictors can be positioned in various locations in conventional valve systems.

The conventional restrictive flow orifice, for example, is a fluid flow restrictor employed for lowering the risk of catastrophic failure by reducing the mass flow release rate of fluid from the fluid container in the event of a system failure. Sometimes conventional restrictive flow orifices are placed upstream of any pressure regulation apparatus. Other times these conventional restrictive flow orifices are placed in the outlet of the fluid container valve, where such outlets typically have connections made according to Compressed Gas Association (CGA) standard V-1.

Conventional configuration of fluid flow restrictors, such as restrictive flow orifices, has been documented. For example, guidance on the conventional configuration of restrictive flow orifices is provided by the Semiconductor Equipment and Materials International (SEMI) Standards S5-93 and S5-0703. These SEMI Standards provide a safety guideline method for limiting the release of hazardous gases from a gas cylinder valve during transportation, storage and use. The SEMI Standards recommend that conventional flow limiting devices limit mass flow to a maximum allowable mass flow release rate based on full flow conditions, i.e. high tank pressures at 700 kilopascals (100 pounds per square inch gage) and higher. Other standards may contemplate maximum allowable mass flow rates based on higher or lower tank pressures depending on the user's application and the hazardous fluid used.

Standards, such as the SEMI standards, provide a method of configuring fluid flow restrictors based on a "worst-case" mass flow release rate. By using the "worst case" mass flow release rate, the fluid flow restrictor can be configured to limit mass flow to a maximum allowable mass flow release rate from a fluid container. Use of the "worst-case" mass flow release rate to configure the fluid flow restrictor means that the dimensions of the fluid flow path through the fluid flow restrictor are calculated using: a maximum fluid pressure of the fluid in the container, which is typically when the fluid container is at approximately its full capacity, the fluid density, and the allowable maximum mass flow release rate, which is usually dictated by safety regulations.

A fluid flow restrictor configured based on the "worst-case" release rate can have a number of disadvantages. Some of the disadvantages of configuring the conventional restrictive flow orifices based on the "worst case" mass flow release rate can be understood in the context of silane ($SiH_4$) discharge from a fluid container. Silane is a spontaneously combustible gas and is recognized as having a high level of risk associated with its use requiring the highest level of risk mitigation for this gas.

One disadvantage is that, when the fluid container is filled with silane to the fill capacity of the fluid container, the resulting worst-case mass flow release rate of silane through a conventionally configured restrictive flow orifice normally will exceed the maximum allowable mass flow rate. One conventional practice to overcome this problem is to fill the fluid container to a lower pressure to satisfy the maximum allowable mass flow rate standard. Another practice is to put in a smaller restrictive flow orifice to limit the mass flow to the maximum allowable mass flow rate standard. Filling the fluid container with less fluid or using a smaller orifice is done at the price of added operational costs.

Another disadvantage of configuring a conventionally configured restrictive flow orifice based on the "worst case" mass flow release is that the contents of the fluid container cannot be fully utilized. For example, as silane is depleted from the fluid container, the delivery pressure steadily falls. Assuming that the silane flows at sonic velocity, the corresponding fall of the delivery pressure results in the maximum mass flow rate through the restrictive flow orifice dropping proportionally. At some point, the conventional cylinder valve system is no longer capable of supplying the fluid at a mass flow rate sufficient to meet the process demand. When such insufficient flow rate conditions occur, the conventional valve system must be taken off line, which wastes the remaining valuable gas that could not be utilized or withdrawn for the process application. Therefore, by not fully utilizing the fluid from the fluid container, the user incurs increased operational costs when using the conventional valve system.

BRIEF SUMMARY OF THE INVENTION

In accordance with at least one embodiment of the present invention, a fluid control and gas delivery assembly for containing, receiving and storing hazardous fluids and for dispensing gas has been developed which comprises a fluid container, a fluid fill path, a gas dispensing path, a first shut-off valve, a pressure reducer, a fluid flow restrictor, a second shut-off valve and a fluid outlet connector. The fluid container has a wall separating an interior volume from a region outside said container, wherein the container is adapted for containing a fluid at a first pressure, where the first pressure is the pressure of the fluid when the container is at the container fill capacity. The fluid fill path extends through said wall from said region outside said container to said interior volume. The gas dispensing path extends through the wall from the interior volume to the region outside said container, the gas dispensing path being non-coextensive with the fluid fill path. The first shut-off valve is positioned in said gas dispensing path. The pressure reducer is also positioned in said gas dispensing path downstream of the first shut-off valve to reduce the pressure of the fluid flowing upstream of the pressure reducer to a delivery pressure. A fluid flow restrictor is positioned in said gas dispensing path downstream of the pressure reducer, the restrictor has a fluid flow restriction path that is configured to restrict the flow of the fluid delivered to the fluid flow restrictor at the delivery pressure to a maximum mass flow rate that is equal to or less than the maximum allowable mass flow rate standard for the hazardous fluid. In addition, a second shut-off valve is positioned in said gas dispensing path downstream of said pressure reducer. The outlet connector is disposed in said gas dispensing path downstream of said first and second shut-off valves and is adapted for making and breaking a low-pressure connection between the gas dispensing path and apparatus for utilizing gas.

In another aspect of this invention, a method for storage and dispensing of a gas is provided which comprises containing a gas in a confined state in a fluid control and gas delivery assembly according to the present invention; and selectively dispensing the confined gas by actuating the first shut-off valve to discharge the gas from the container.

In a further aspect of this invention, a method of manufacturing a semiconductor product is provided that comprises: containing a fluid in a confined state in a fluid control and gas delivery assembly according to the present invention; selectively dispensing the confined fluid by actuating the first shut-off valve to discharge the gas from the fluid container; and using the discharged gas in the manufacture of a semiconductor product.

In yet a further aspect of this invention, a method for replacing the source of gas, in an apparatus for utilizing the gas, without breaking a high pressure connection is provided that comprises

- providing first and second supplies of gas, each supply comprising a fluid container adapted for storing a fluid at a first pressure and having a wall separating an interior volume from a region outside said fluid container and a primary gas control module mounted on said fluid container.
- providing an apparatus for using the gas, said apparatus having a low-pressure inlet and an inlet connector, said inlet connector initially being coupled to the outlet connector of said first supply of gas to supply gas from said first supply to said apparatus;
- closing the shut-off valve of said first supply of gas to isolate said first supply of gas from said apparatus for using the gas;
- breaking the low-pressure connection between the connectors of said first supply of gas and said apparatus for using the gas;
- replacing said first supply of gas with said second supply of gas;
- making a low-pressure connection between the connectors of said second supply of gas and said apparatus for using the gas, while the shut-off valve of said second supply of gas is closed; and
- allowing the shut-off valve of said second supply of gas to be opened, which allows gas to flow from said second supply to said apparatus for using the gas.

The primary gas control module comprises a gas dispensing path, a fluid fill path, a first shut-off valve, a pressure reducer, a fluid flow restrictor, a second shut-off valve and an outlet connector. The gas dispensing path extends through the wall from the interior volume to the region outside of the container and is non-coextensive with said fluid fill path.

The first shut-off valve is positioned in said gas dispensing path. The pressure reducer is positioned in said gas dispensing path downstream of the first shut-off valve to reduce the pressure of the fluid flowing upstream of the pressure reducer to a delivery pressure. A fluid flow restrictor is positioned in said gas dispensing path downstream of the pressure reducer, said restrictor having a fluid flow restricting path configured to restrict the flow of the fluid delivered to the fluid flow restrictor at the delivery pressure to a maximum mass flow rate that is equal to or less than the maximum allowable mass flow rate standard for the hazardous fluid. The second shut-off valve positioned in said gas dispensing path downstream of said pressure reducer. An outlet connector is disposed in said gas dispensing path downstream of said first and second shut-off valves and is adapted for making and breaking a low-pressure connection between said gas dispensing path and apparatus for utilizing gas.

Other optional components may be incorporated into the present invention, such as filtration, purge protection, backflow protection, fluid level measurements, variable pressure control, flow control and an electronic flow control and monitoring system.

Preferred and optional features that have been set out with regard to previous and subsequent aspects of the invention, may also be provided in accordance with this aspect of the invention. It is to be appreciated that where features of the invention are set out herein with regard to devices according to the invention, such features may also be provided with regard to a method according to the invention, and vice versa.

BRIEF DESCRIPTION OF SEVERAL VIEWS OF THE DRAWINGS

The foregoing summary, as well as the following detailed description of certain embodiments of the present invention, is further understood when read in conjunction with the appended figures. These figures illustrate certain embodiments of the invention. One of ordinary skill in the art will readily understand, however, that the present invention is not limited to the arrangement and instrumentalities shown in the attached figures.

Like reference characters on the several figures indicate like or similar parts.

DESCRIPTION OF THE INVENTION

Figure 1:
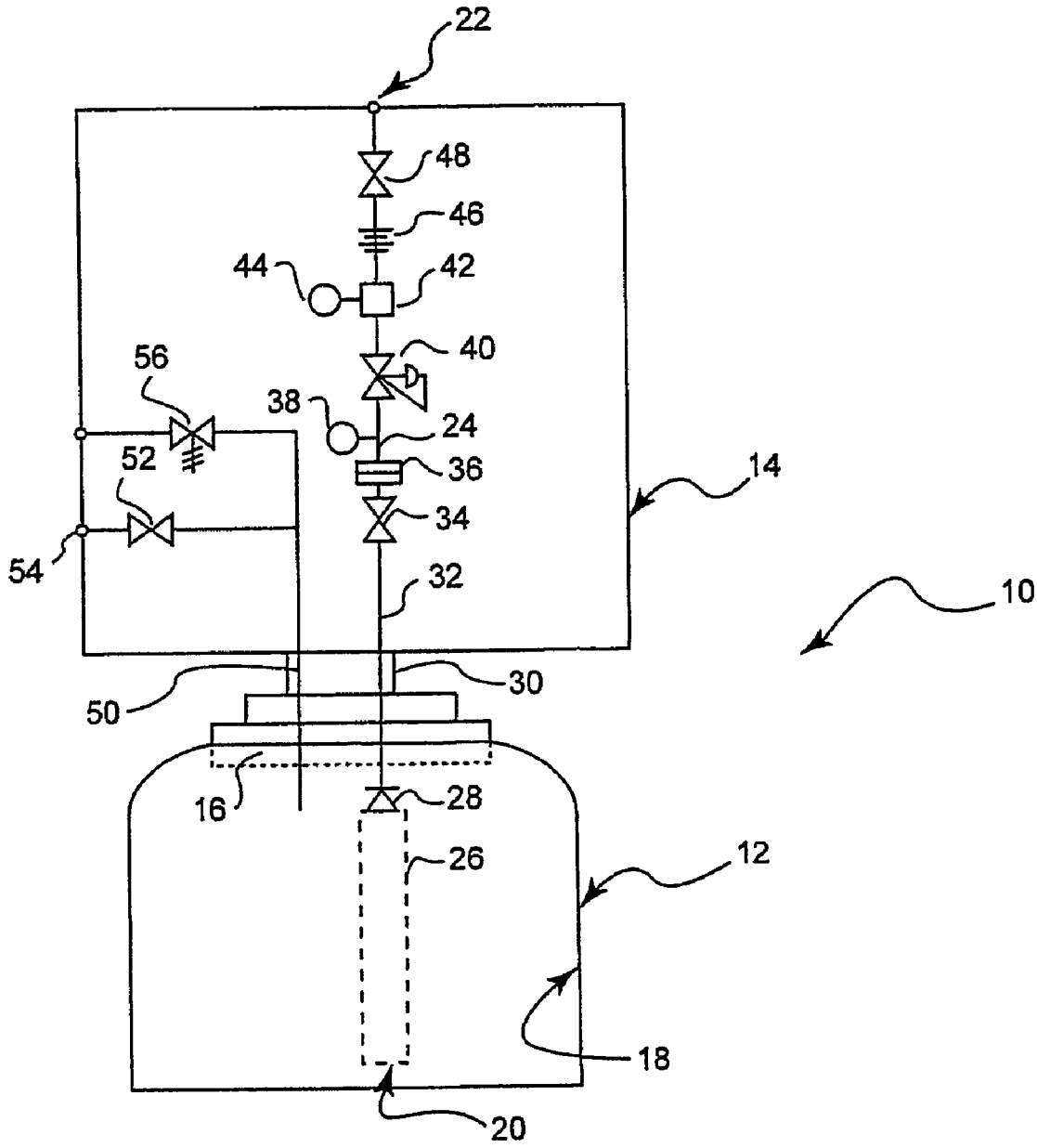
FIG. 1 is a process flow diagram of a fluid control and gas delivery assembly having an integrated fluid flow restrictor for containing, receiving and storing fluids and for dispensing gas from a fluid container in accordance with one embodiment of the present invention.

Referring now to the drawings, wherein like reference numbers refer to like elements throughout the several views, FIGS. 1 through 6 show several configurations of an assembly for containing and delivering hazardous fluids from a pressurized container. Because the common details are given the same reference numbers in each of the figures, their construction and operation will not be reiterated for each figure.

For the purposes of the present invention, the term "fluid" includes gases and liquids. The term "gas" encompasses both a permanent gas and a vapor of a liquefied gas. Unless otherwise indicated, all pressures discussed will be absolute pressures.

Permanent gases are gases that cannot be liquefied by pressure alone at ambient temperature, and for example can be supplied in fluid containers at pressures up to 300 bar gage. Examples are argon and nitrogen.

Fluids that liquefy under pressure as they are compressed for filling into a fluid container are not permanent gases and are more accurately described as liquefied gases under pressure or as vapors of liquefied gases. Vapors of liquefied gases are present above the liquid in a compressed gas fluid container. As an example, nitrous oxide is supplied in a fluid container in liquid form, with an equilibrium vapor pressure of 44.4 bar gage at 15 degrees Celsius. Such vapors are not permanent or true gases as they are liquefiable at a pressure and temperature approximating atmospheric conditions.

Generally, a fluid is hazardous, as defined by the National Fire Protection Association Standard (NFPAS) 704, when the fluid is classified as a class 3 or 4 fluid due to its degree of hazard in health, flammability, or reactivity. Other standards issuing organizations may define a "hazardous" fluid differently than in the NFPAS 703 classes 3 or 4. Hazardous fluids, therefore, may be defined in various ways, but still could be used and remain within the scope and range of the claims without departing from the spirit of the invention.

Examples of fluids contemplated for use with the present invention are numerous. Some examples are: acetylene, ammonia, argon, arsine, boron tribromide, boron trichloride, boron trifluoride, boron-11 trifluoride, carbon dioxide, carbon monoxide, chlorine, chlorine trifluoride, deuterium, diborane, dichlorosilane, disilane, fluorine, germane, helium, hydrogen, hydrogen bromide, hydrogen chloride, hydrogen fluoride, hydrogen iodide, hydrogen selenide, hydrogen sulfide, methane, methylsilane, nitric oxide, nitrogen, nitrogen trifluoride, nitrous oxide, oxygen, phosphine, silane, silicon tetrachloride, silicon tetrafluoride, stibine, sulfur dioxide, sulfur hexafluoride, trichlorosilane, tungsten hexafluoride, xenon, and mixtures and formulations thereof. Some of the above fluids when used alone are hazardous. Other fluids listed above become hazardous when used in mixtures with other fluids.

Figure 2:
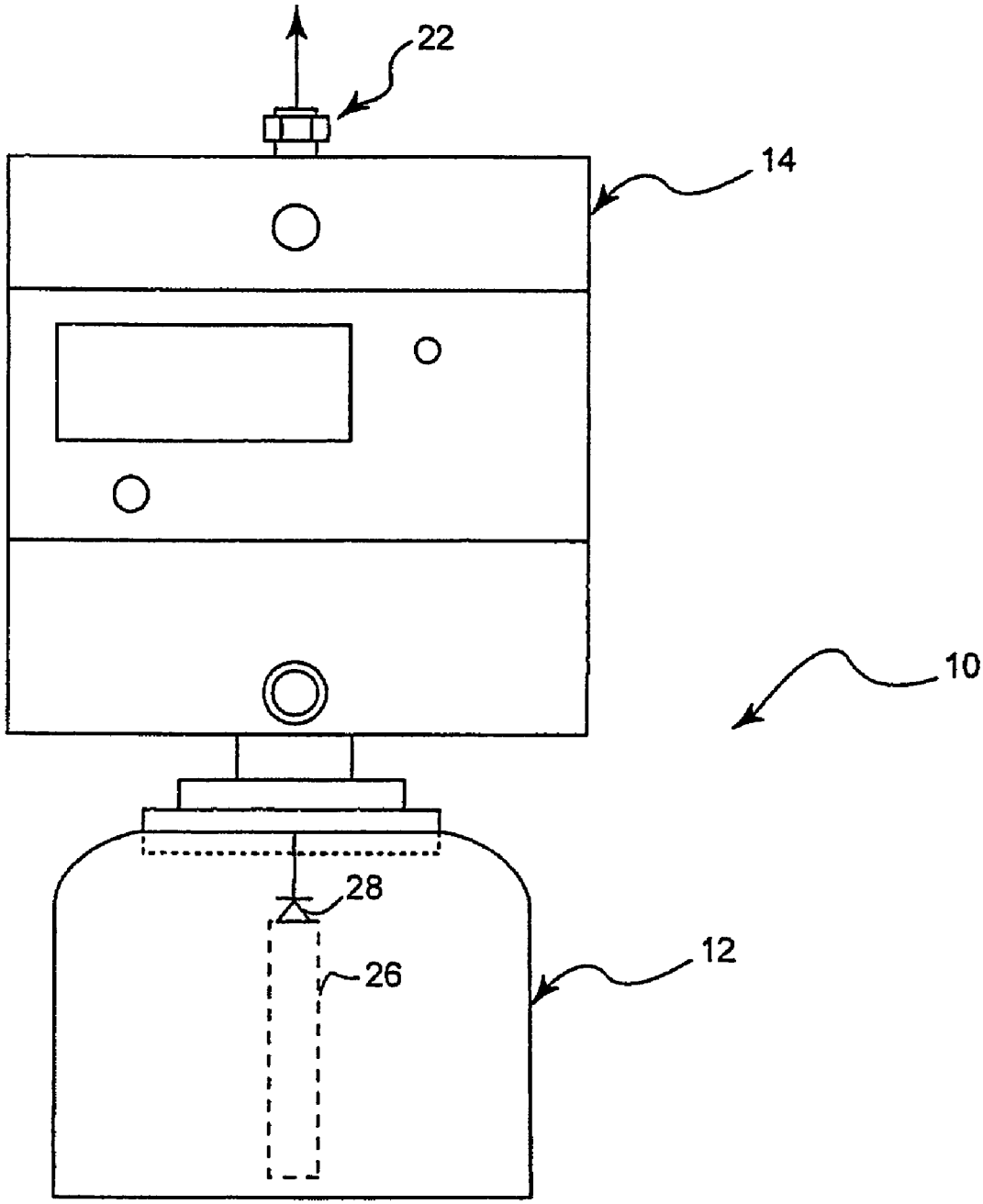
FIG. 2 is a front elevation view of a configuration of a fluid control and gas delivery assembly having an integrated fluid flow restrictor for containing, receiving and storing fluids and for dispensing gas from a fluid container in accordance with one embodiment of the present invention.

FIG. 1 depicts a fluid control and gas delivery assembly 10 for containing, receiving and storing hazardous fluids and for dispensing gas. FIG. 2 is a front elevation view of the exterior of the apparatus shown in FIG. 1. The assembly 10 is illustrated in the form of a fluid container 12 having an integral valve assembly 14 attached to the fluid container 12.

Typically, the fluid container 12 will be in the form of a standard compressed fluid container and will have a fluid container orifice 16. The fluid container orifice 16 of the fluid container 12 is open to an interior volume defined by the wall 18 of the fluid container 12.

The fluid container 12 is adapted to contain a fluid under a first pressure, where the first pressure is the pressure of the fluid at the fill capacity of the fluid container 12. The fill capacity of the fluid container 12 will typically be a pressure of up to about 24500 kilopascals (kPa) (2553 pounds per square inch gage (psig)). The fill capacity will vary from tank to tank depending on various factors, such as the container size, configuration, and the user's application requirements. The fluid container 12 can optionally include a pressure sensor to measure internal pressures up to the full cylinder pressure or fill capacity of the fluid container 12.

In one embodiment, the integral valve assembly 14 is made of stainless steel AISI 316-L, the seats, valves and regulators are made of polychlorotrifluoroethylene (PCTFE), and the internal parts in contact with the fluid are made of stainless steel or nickel. Other suitable materials can be used.

The integral valve assembly 14 is in sealed communication with the fluid container orifice 16. In one embodiment, the integral valve assembly 14 is welded to the fluid container 12 at about the fluid container orifice 16. For example, when a user seeks to deliver low vapor pressure fluids, it may be possible to have the integral valve assembly 14 welded, or otherwise integrally attached, onto the fluid container 12 to ensure complete sealing without valve threads.

Several of the advantages of this invention are achieved by building into the integral valve assembly 14 a number of flow control and measurement components. Additional advantages are achieved by adding discrete modules performing different functions depending upon operation of internal components, arranged in the manner of the modular integral valve assembly of U.S. Pat. No. 6,314,986 B1 ("'986 patent"). That is, the integral valve assembly 14 may be constructed of modular components such that the variations taught in the '986 patent may be easily manufactured and easily changed by a user. As will become readily apparent, the fluid control arrangement disclosed by the '986 patent has application with the present invention. Accordingly, the '986 patent is incorporated herein expressly by reference in its entirety.

The integral valve assembly 14 has a fluid delivery inlet 20 and a fluid delivery outlet 22. The fluid delivery outlet 22, for example, can be specified in accordance with the Diameter Index Safety System of the Compressed Gas Association and allows connection to the user's process equipment by using the appropriate connection adapter. The fluid delivery outlet 22 can be, for example, a quick connect output connector, a face seal connector, a compression fitting, a threaded connector, or other conventional connector. The inlet and outlet connections of the assembly 14 will usually be selected according to CGA V-1 or EN629-1, where applicable. A person of ordinary skill will understand that various other suitable connections can be used and remain within the scope and range of the claims without departing from the spirit of the invention.

Figure 3:
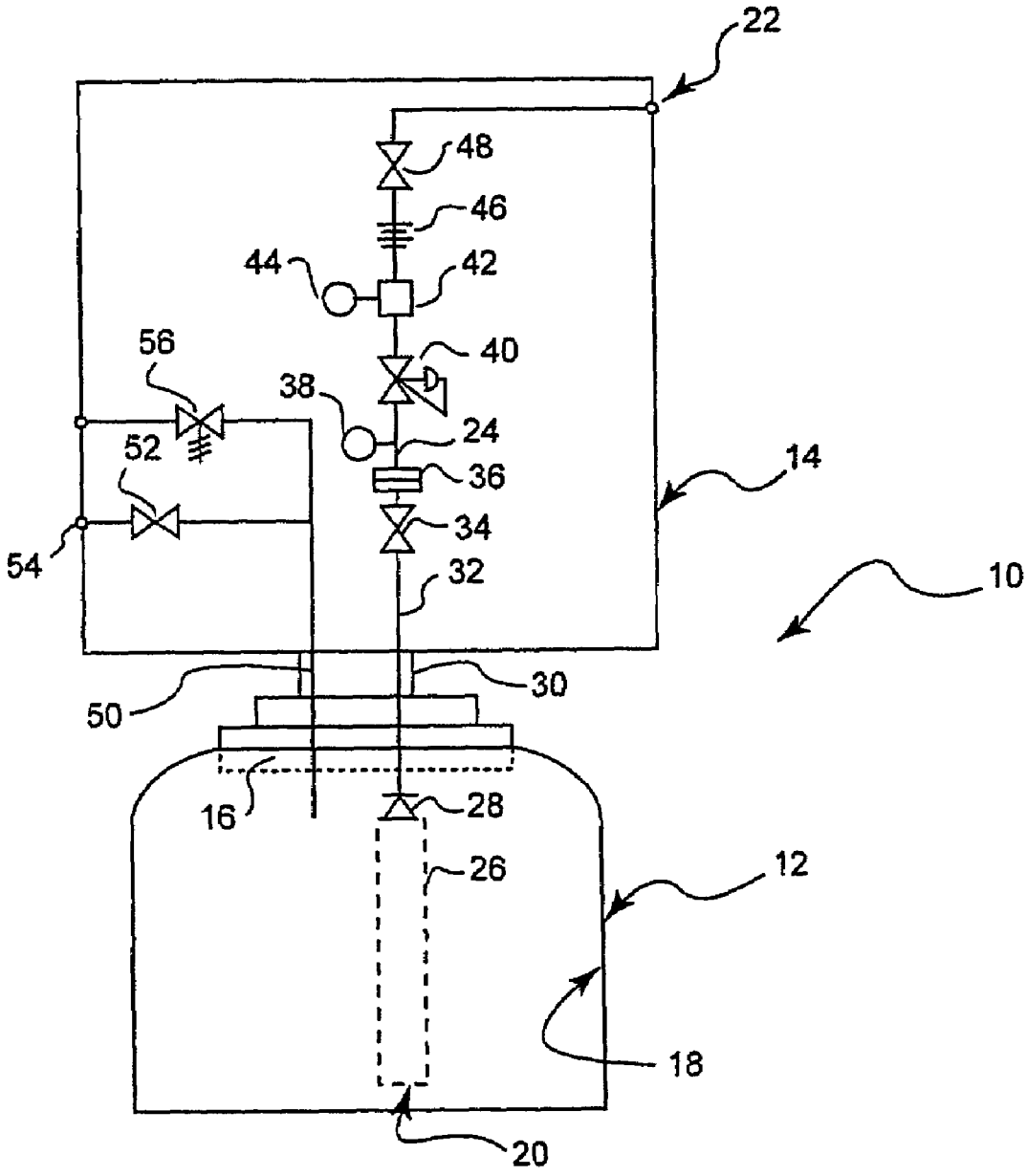
FIG. 3 is a process flow diagram of a fluid control and gas delivery assembly having an integrated fluid flow restrictor for containing, receiving and storing fluids and for dispensing gas from a fluid container in accordance with one embodiment of the present invention, where the fluid outlet is located on a side of the integral valve assembly, when the assembly is in its normal upright position.

In one embodiment, as shown in FIG. 3, the fluid delivery outlet 22 will be oriented sideways relative to the integral valve assembly 14, preferably facing in a horizontal direction, when the vessel 12 is in its normal upright position. As has been explained, the advantage of this outlet configuration is that, especially in industrial situations, the fluid delivery outlet 22 is less likely to be contaminated by falling contaminants, if it is mounted in a side face of the unit, facing sideways, rather than in a top face, facing upwardly.

The fluid delivery outlet 22 is typically covered by a removable cover (not shown). Also, the appropriate keyed fluid container connections recommended by the Compressed Gas Association may be used. As a possible extension, custom keyed connections could be instituted to ensure incompatible fluids were not mistakenly connected.

As shown in FIGS. 1, 3, 4, 5 and 6, a gas dispensing path, shown generally at 24, extends through said wall 18 from the interior volume of the fluid container 12 to a region outside of the fluid container 12, and more particularly, the gas dispensing path can extend between approximately the fluid delivery inlet 20 and the fluid delivery outlet 22. The gas dispensing path 24 may either be coextensive or non-coextensive, at least partially, with the other flow paths described herein.

In one embodiment, the fluid delivery inlet 20 is upstream of an optional purifier 26 that is positioned in the gas dispensing path 24. A person of ordinary skill will understand that various suitable locations for the fluid delivery inlet 20 can be used within the scope and range of the claims without departing from the spirit of the invention.

A purifier is disclosed in U.S. Pat. No. 5,409,526, assigned to Air Products, which is incorporated herein by reference in its entirety. U.S. Pat. No. 5,409,526 (issued on Apr. 25, 1996, "'526 patent") discloses an apparatus that permits refill of the fluid container without making or breaking a high pressure connection. In particular, the '526 patent discloses an apparatus for supplying high purity gas comprising a fluid container having a valve with two internal ports. One internal port is used to fill the fluid container while the other is fitted with a purifier unit, which removes particulates and impurities from the gas as it leaves the fluid container. The provision of two internal ports and internal valves allows the container to be filled without passing the filling gas through the internal filter unit. The purifier and filtration media are added as cartridges to the fluid container valve.

In an embodiment of the present invention, the location for the purifier 26 is inside of the fluid container 12. The purifier 26 can also filter particles to achieve a very high purification of fluid container gases, which has not normally been available in known fluid container gas products. The purifier 26 includes a purifier, which can conveniently comprise a unit containing a substance selected from the group consisting of adsorbents, absorbents, catalysts and mixtures thereof, whereby impurities are removed from the gas as it is withdrawn from the container thorough the unit. The purifier 26 can purify gas to a standard of parts per billion (ppb) of impurities, or even parts per trillion (ppt), which cannot be achieved by previous purifiers.

Also, a residual pressure valve 28 may be located downstream of the purifier 26. A person of ordinary skill will understand that various suitable locations for the residual pressure valve 28 can be used within the scope and range of the claims without departing from the spirit of the invention. The residual pressure valve 28 is typically a check valve set to have a nominal crack pressure between 303–365 kilopascals (kPa) (43.9–53 psi). The residual pressure valve 28, as can be seen in FIGS. 1–6, can be connected upstream of a first shut-off valve 34 to prevent back flow of foreign fluids.

An input connector 30 can be adapted to connect the integral valve assembly 14 in fluid flow communication with the interior volume of the fluid container 12. When an input connector 30 is included, the input connector 30 can extend into the fluid container 12. The input connector 30 comprises a connecting gas flow dispensing path 32 communicating with the purifier 26 by way of a residual pressure valve 28. The connecting gas flow dispensing path 32 and the gas dispensing path 24 can be coextensive with one another.

In this embodiment, at least one first shut-off valve 34 integral to the integral valve assembly 14 is positioned on the high pressure, i.e. upstream, side of a pressure reducer 40. The first shut-off valve 34 is positioned in the gas dispensing path 24.

The first shut-off valve 34 selectively opens and sealingly closes to control fluid flow along the gas dispensing path 24. The first shut-off valve 34 is biased to be normally closed, particularly when no system application is connected to the fluid delivery outlet 22 of the integral valve assembly 14. The first shut-off valve 34 also acts to isolate the pressure reducer 40 from the fluid contained upstream in the fluid container 12 at high pressure, when the fluid container 12 is filled or when the pressure reducer 40 is serviced. The first shut-off valve 34 is preferably located as close to the fluid container 12 as possible to enhance system safety. This first shut-off valve 34 serves as a back-up to the pressure reducer 40 in preventing unintentional fluid release during transportation, connection and disconnection from a user's application apparatus (not shown) downstream of the integral valve assembly 14.

The first shut-off valve 34 can be manually operated. The first shut-off valve 34 can also be actuated pneumatically, electromechanically or otherwise.

The output of the first shut-off valve 34 is optionally connected to a filter 36. If the optional filter 36 is connected to the output of the first shut-off valve 34, the filter 36 is connected upstream of, or to, the pressure reducer 40.

A high pressure gauge 38 may be optionally provided to indicate the pressure in the fluid container 12. The high pressure gauge 38 serves to, among other things, indicate the pressure of the fluid in the fluid container 12, so that the fluid container 12 can be changed when empty.

The present invention includes at least one pressure reducer 40 that is positioned in the gas dispensing path 24 and downstream of the fluid delivery inlet 20 and the first shut-off valve 34. The pressure reducer 40 may typically take the form of a self-regulating mechanical device that is used to reduce the pressure of the dispensed gas. One example of a pressure reducer 40 is a pressure regulator that incorporates a diaphragm or a piston connected to a valve as a way of reducing the pressure of the gas dispensed from the fluid container 12. The pressure reducer 40 may be fixed at a pre-set pressure or may be variable. In one embodiment, the pressure reducer 40 is a single stage diaphragm design. In another embodiment, the pressure reducer 40 is a tubular pressure regulator. The pressure reducer 40 can also take the form of an expansion valve, a two-stage diaphragm regulator, or any other apparatus that can reduce or regulate pressure.

The pressure reducer 40 can be set at a predetermined level to dispense gas or vapor from the fluid container 12 when the pressure level is super-atmospheric, sub-atmospheric, or atmospheric pressure, depending on the desired dispensing conditions. In one embodiment, the pressure reducer 40 is selected to deliver fluid at low positive, super atmospheric pressure regulation to the fluid flow restrictor and will typically be set to deliver fluid to the fluid flow restrictor at a pressure of about 1–5 bar (99.97 kPa to 499 kPa or 14.5 to 72.5 psi) with delivery pressures at the outlet of about 1–7 bar (99.97 kPa to 699 kPa or 14.5 psi to 101.5 psi). The pressure reducer 40 reduces the pressure of the fluid flowing upstream of the pressure reducer 40 to a lower pressure of fluid flowing downstream of the pressure reducer 40, which will typically be within the delivery pressures required by the user's application. In practice, the pressure reducer 40 can have a delivery pressure set by the supplier or fluid container owner to further minimize the possibility of human error.

Regarding the adjustability of the pressure reducer 40, the delivery pressure setting of the pressure reducer 40 may be adjusted by use of a fixed spring, or by use of an adjustable spring requiring a special key to adjust it, or by use of a partially evacuated or pressurized dome load. Alternatively, the pressure reducer 40 could be a micro-electromechanical system (MEMS) comprised of a pressure sensor and a micromachined control valve both etched, for example, in a single silicon wafer that is part of the gas dispensing path 24. Thus, the pressure reducer 40 can be operated manually (for example, by a knob) or by other well known expedients, including electronically, pneumatically or otherwise mechanically actuated device.

Directly combining a pressure reducer 40 with the purifier 26 without any joints reduces particle generation, which has added benefits to the user. In prior systems, the purified gas reaches the tool in the usage circuit by passing through a series of discrete flow control components that are connected to each other via valves and fittings.

Placing the pressure reducer 40 downstream of the purifier 26 in the integral valve assembly 14, with minimized volume and the least number of connections in the downstream path from the purifier 26, also is an effective way to minimize contamination. The purifier 26 can remove moisture to reduce the corrosivity of the gas and the pressure reducer 40 can reduce the outlet pressure to further reduce the corrosiveness. If a purifier 26 is not included in assembly 14, the pressure reducer 40 in the present invention, however, could fulfill the role of inhibiting backflow itself.

The outlet of the pressure reducer 40 is optionally connected to a pressure switch or flow switch 42 for further controlling the low pressure flow downstream of the pressure reducer 40. The pressure switch or flow switch 42 may, for example, be replaced by a manually operated needle valve or metering valve.

Optionally, a low pressure gauge 44 can be connected to the pressure/flow switch 42 or downstream of the pressure reducer 40 to indicate the pressure in the low pressure portion of the integral valve assembly 14. The high pressure gauge 38 and low pressure gauge 44, as discussed above, may be mechanical display gauges or may be electronic gauges, which provide an electrical output.

Also, the optional low pressure gauge 44 may be calibrated for use in monitoring the delivery pressure. Additionally, the optional high pressure gauge 38, upstream of the pressure reducer 40, can be included for non-liquefied compressed fluids to indicate the content of fluid in the fluid container 12.

One of the advantages of the present invention is that, by locating and configuring a flow restrictor 46 to take advantage of the reduced pressure downstream of the pressure reducer 40, an increase in fluid utilization from the fluid container and reduction in the maximum release rate of the gas in the event of catastrophic system failure can be achieved. The flow restrictor 46 is positioned downstream of the pressure reducer 40 and in the gas flow dispensing path 24. The fluid flow restrictor 46 defines a fluid flow restricting path, which can be one or more orifices, nozzles, capillary tubes, conduits or other suitable fluid flow restricting path. Typically, the gas supplier or fluid container owner will install, remove or otherwise service the flow restrictor 46.

The flow restrictor 46 is configured based on the pressure delivered from the upstream flow regulation devices, like the pressure reducer 40, as opposed to a much higher pressure of the full container pressure (as is done conventionally). The flow restrictor 46 is configured to restrict the flow of the fluid to a maximum mass flow rate that is equal to or less than the maximum allowable mass flow rate dictated by a governing standard for the user's application.

For example, Semiconductor Equipment and Materials International (SEMI), government and other standard issuing organizations and associations set the maximum allowable mass flow rates for hazardous fluid depending on the hazard and user's application. It is expected that the governing mass flow rate standards might change. In particular, a future maximum allowable flow rate standard, higher or lower than the present standards, can be used and be within the scope and range of the claims without departing from the spirit of the invention.

In configuring the fluid flow restrictor 46, there are generally two fluid flow regimes, critical and sub-critical, for fluid flow through a flow restrictor that can be considered. In the sub-critical fluid flow regime, the velocity of the fluid flowing through the flow restrictor 46 depends on both the upstream and downstream pressure. Sub-critical fluid flow occurs only when the ratio of the pressures upstream and downstream of the flow restrictor 46 (defined below as $R_p$) is greater than the critical pressure ratio (defined below as $R_c$).

Conversely, critical fluid flow (also called "choked flow" or flow at "sonic velocity") occurs when $R_p<R_c$. Or, put another way, critical flow occurs when the downstream absolute pressure ($P_2$) is fifty-two and eight-tenths percent (52.8%) of the upstream absolute pressure ($P_1$). In the critical flow regime, the fluid flow reaches its sonic velocity, so that the mass flow rate depends only on the density of the gas as it passes through the narrowest opening. As a result, critical flow does not depend on the downstream pressure as long as $R_p<R_c$.

The cross-sectional area of the opening through the fluid flow restricting path of the flow restrictor 46 is determined by the following relationship:

$$\text{Area of the fluid flow restrictor} = \frac{MassFlowRate}{C_w(\text{density})(\text{velocity})}$$

Variations on the above relation may apply depending on the type of fluid flow restrictor used. For example, it is understood that the restrictive flow orifice, nozzle or venturi can be configured, depending on the fluid flow regime, based on the following relationships:

Area of the fluid flow restrictor (critical flow):

$$\frac{MassFlowRate}{C_w\sqrt{kP_1D_1\left(\frac{2}{k+1}\right)^{\frac{(k+1)}{(k-1)}}}} = \frac{MassFlowRate}{C_w\sqrt{\frac{kP_1^2M}{ZRT}\left(\frac{2}{k+1}\right)^{\frac{(k+1)}{(k-1)}}}}$$

Area of the fluid flow restrictor (sub-critical flow):

$$\frac{MassFlowRate}{C_w\sqrt{\frac{2P_1^2M}{ZRT}\left(\frac{k}{k-1}\right)\left(R_p^{\frac{2}{k}} - R_p^{\left(1+\frac{1}{k}\right)}\right)}}$$

where applicable for the above equation:

$P_1$=pressure upstream of the fluid flow restrictor $P_2$=pressure downstream of the fluid flow restrictor [for atmospheric leak cases, $P_2$ is atmospheric pressure 14.7 pounds per square inch absolute or 101325 Pa]

d=orifice diameter (meters)

D=gas density (kilograms per cubic meter ($kg/m^3$))

M=molecular weight of the gas (kilograms per gram-mole)

$k=C_p/C_v$ (at standard temperature and pressure conditions)

A=cross-sectional area of the opening through the fluid flow restricting path of the flow restrictor (square meters($m^2$))

R=ideal gas constant=8.314 joules per mol·K

T=temperature in degrees Kelvin (° K)

$R_p$=pressure ratio ($P_2/P_1$)

$R_c$=

$$\text{critical pressure ratio} = \left(\frac{k+1}{2}\right)^{\frac{k}{1-k}}$$

Z=

$$\text{compressibility factor for non-ideal gas} = \frac{PV}{\left(\frac{m}{M}\right)RT} \text{ or } \frac{PM}{DRT}$$

$C_w$=discharge coefficient.

The discharge coefficient takes into account that the area of the flow stream at its narrowest point, the so-called vena contracta, is narrower than the geometrical opening of the orifice, A. It is derived from Shapiro's correlation chart (see, e.g., Shapiro, A. H. The Dynamics and Thermodynamics of Compressible Fluid Flow; Ronald Press: New York; 1953; V.1, ch. 4.) and fit to equation:

$$0.85+0.104167Rp-0.875\,Rp^2+0.52083\,Rp^3$$

In one embodiment, the flow restrictor 46 takes the form of a restrictive flow orifice (known as an RFO). The cross sectional area of the opening of such a restrictive flow orifice determined in accordance with the present invention is computed using the pressure delivered to the fluid flow restrictor from the upstream fluid flow regulation devices, like the pressure reducer 40 (as opposed to using the full fluid container pressure), to configure the restrictive flow orifice.

For example, when silane is passed through a fluid flow restrictor, in this case, a restrictive flow orifice, the maximum allowable fluid flow rate through the orifice set forth by the Semi Standard S5-93 is 7.6 standard liters per minute (slpm), which is computed assuming a full tank pressure of 700 kilopascals (kPa), i.e., full flow conditions, and the C-type orifice size. Under such pressure and flow rate conditions, solving the mass flow rate equations for area and assuming critical flow, the cross-sectional area of the opening of the fluid flow restricting path called for by the SEMI S5–93 standard is 0.3511 millimeters (0.0138 inches). Specifically, the cross-sectional area of the opening through fluid flow restricting path of the flow restrictor is computed as follows:

temperature = 294.2 K (21.1° C.),
$P_1 = 7.00 \times 10^6$ Pa,
$P_2 = 1.01 \times 10^5$ Pa,
M = 0.0321 kg/gmole,
k = 1.25,
Mass Flow Rate = $1.83 \times 10^{-4}$ kg/s
(note that vapor density at 0° C. and
101325 Pa (STP) is 1.44 kg per cubic meter,
so $1.83 \times 10^{-4}$ kg per second is
equivalent to 7.6 slpm),
$R_p = 0.017$,
Rc = 0.555,
Z = 0.558 (silane is a highly non-ideal gas),
and $C_w = 0.85$.

$$MFR = (0.85)(OrificeArea)\sqrt{\frac{(1.25)(7.00\times10^6\text{Pa})^2\left(0.0321\frac{\text{kg}}{\text{mole}}\right)}{(0.558)\left(8.314\frac{\text{J}}{\text{mol}\cdot\text{K}}\right)(294.2\text{ K})}\left(\frac{2}{2.25}\right)^{\frac{2.25}{0.25}}}$$

Design Orifice Area = $9.68 \times 10^{-8}$ $m^2$
(therefore, d = $3.51 \times 10^{-4}$ m, where $A = \frac{\pi d^2}{4}(m^2)$(for a round orifice)

In contrast, the present invention configured with a flow restrictor, here a restrictive flow orifice, to allow 7.6 standard liters per minute (slpm) mass flow rate at the pressure delivered to the fluid flow restrictor, which typically ranges from about 99 kPa to about 499 kPa, equates to orifice diameters corresponding to about 0.9314 millimeters (0.0367 inches) at 99 kPa and about 0.4149 millimeters (0.0163 inches) at 499 kPa. The smaller 0.4149 mm orifice will allow, solving the above equation for the mass flow rate at critical flow and at 700 kilopascals, a flow rate of 10.67 slpm, which exceeds the SEMI standard.

If the fluid flow restrictor takes the form of a restrictive flow orifice, the nominal diameters for orifices suitable for use with this invention are: 0.15, 0.25, 0.5, 0.75, 1.0 and 4.0 mm (0.006, 0.01, 0.02, 0.03, 0.04 and 0.16 inches). Other fluid flow restrictors will be understood by one of skill in the art to be suitable for use in connection with the present invention. In particular, suitable fluid flow restrictors can include one or more filters, flow nozzles, screens, conduits, capillary tubes or venturis. Configuring these elements can be achieved using well known flow computations or empirical data applicable to the particular fluid flow restrictor used in the user's application and would follow computations like those above.

As should now be evident, use of a conventional orifice also results in less of the available fluid to be depleted from the fluid container 12. This, in turn, means that the conventional valve system limits the amount of fluid that can be withdrawn by the user.

At least one second shut-off valve 48 is also included. In this embodiment, the second shut-off valve 48 is integral to the valve assembly 14 and positioned on the low pressure, i.e. downstream, side of a pressure reducer 40. The second shut-off valve 48 is positioned in the gas dispensing path 24.

This second shut-off valve 48 selectively opens and sealingly closes to control fluid along the gas dispensing path 24, which acts to control flow of fluid from the fluid container and to protect the pressure reducer 40 from ingress of ambient gas during storage and transit when the second shut-off valve 48 is in a closed position. When used in connection with the high pressure shut-off valve 34, the pressure reducer 40 can be isolated for maintenance or during the filling of the fluid container 12. This feature can be important when delivering corrosive or reactive fluids such as HCl, HBr, $SiH_4$, $BCl_3$, etc., where air contamination can lead to corrosion or solids formation or both.

Now turning to the embodiment of the present invention that facilitates filling of the fluid container 12, a fluid fill path 50 in the integral valve assembly 14 may be provided between the fluid container orifice 16 of the fluid container 12 and a fluid fill inlet 54 of the integral valve assembly 14. The fluid fill inlet 54 is typically accessed through a sealable cover (not shown).

The fluid fill path 50 may be separate, as shown in the embodiments of FIGS. 1, 3, 4, 5 and 6, or combined with the gas dispensing path 24 by using a bypass line from upstream of the first shut-off valve 34 to downstream of the second shut-off valve 48, for example.

Positioned in the fluid fill path 50 is a fluid fill valve 52. The fluid fill valve 52 selectively opens and sealingly closes to control fluid along the fluid fill path, which acts to control flow of fluid to the fluid container 12. The fluid fill valve 52 can be manually operated. The fluid fill valve 52 can also be actuated pneumatically, electromechanically or otherwise mechanically actuated. Also, in one embodiment, connected to the fluid fill path 50 is an optional safety relief valve, or rupture disc 56. An optional safety relief valve, or rupture disc 56 may be required, for example, by the governing transport authorities.

A person of ordinary skill will understand that various suitable locations for the fluid delivery inlet 20, fluid delivery outlet 22, a connecting gas flow dispensing path 32, fluid fill path 50, and the filling inlet 54 can be used within the scope and range of the claims without departing from the spirit of the invention.

Figure 4:
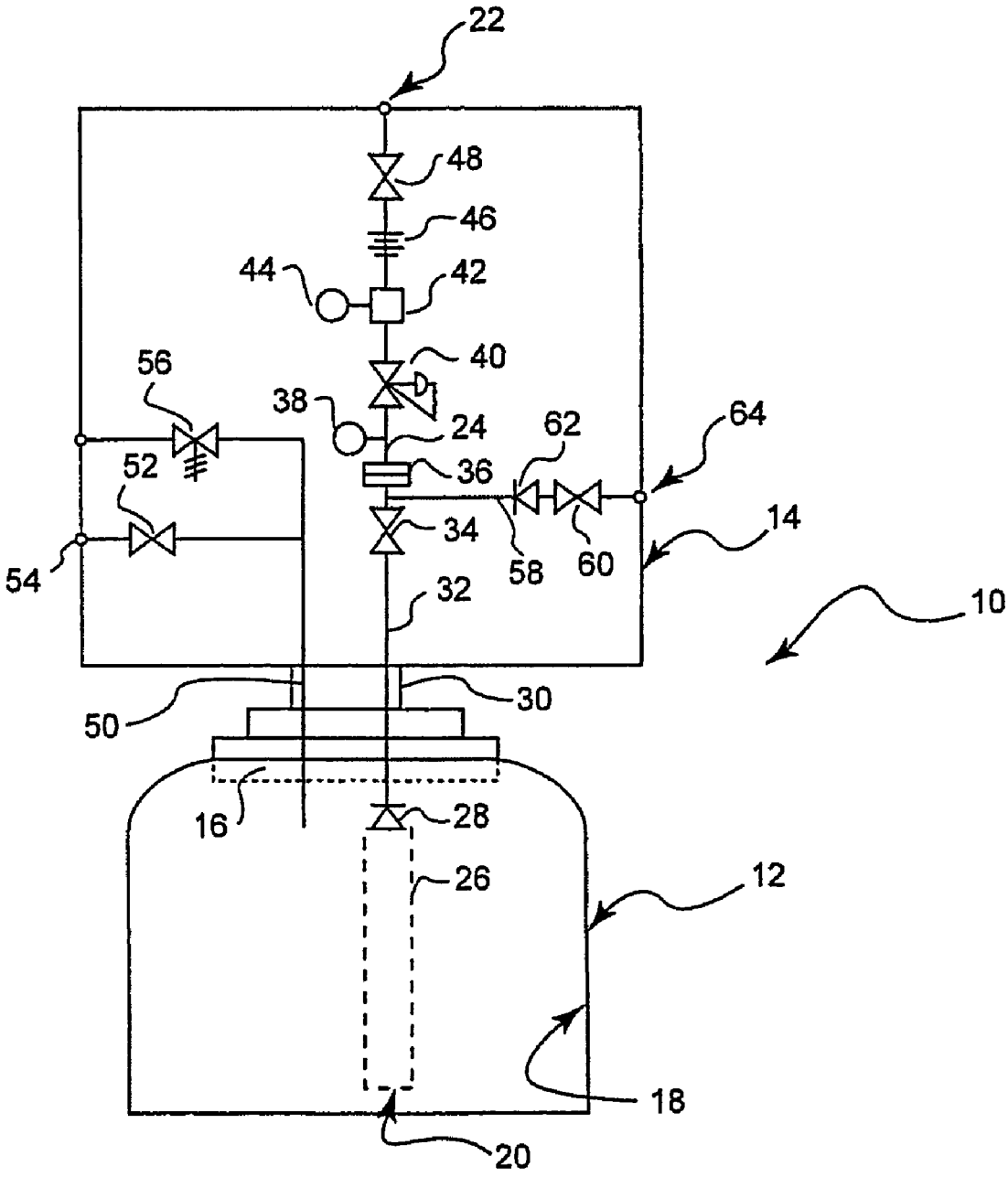
FIG. 4 is a process flow diagram of a fluid control and gas delivery assembly having an integrated fluid flow restrictor for containing, receiving and storing fluids and for dispensing gas from a fluid container in accordance with one embodiment of the present invention, where the fluid control and gas delivery assembly includes a purge gas flow path.

Referring now to FIG. 4 in this embodiment, the integral valve assembly 14 also has an optional purge-gas path 58 communicating with the gas dispensing path 24, at a position upstream of the pressure reducer 40 between the optional filter 36 and the first shut-off valve 34. A purge-gas valve 60 is connected downstream of non-return valve 62 and upstream of a purge-gas inlet 64, which in the present case, is connected to a purge line (not shown). In one mode of operation, an inert fluid (e.g. dry $N_2$, Ar, etc.) may be introduced into the integral valve assembly 14 before closing the second shut-off valve 48 to further reduce the risk of air ingress into the pressure reducer 40 during transit. Thus, a possible additional role of the first shut-off valve 34 is to positively separate and thereby prevent the contamination or dilution of the hazardous process fluid with the inert purge fluid used to blanket the pressure reducer 40 during transit.

Figure 5:
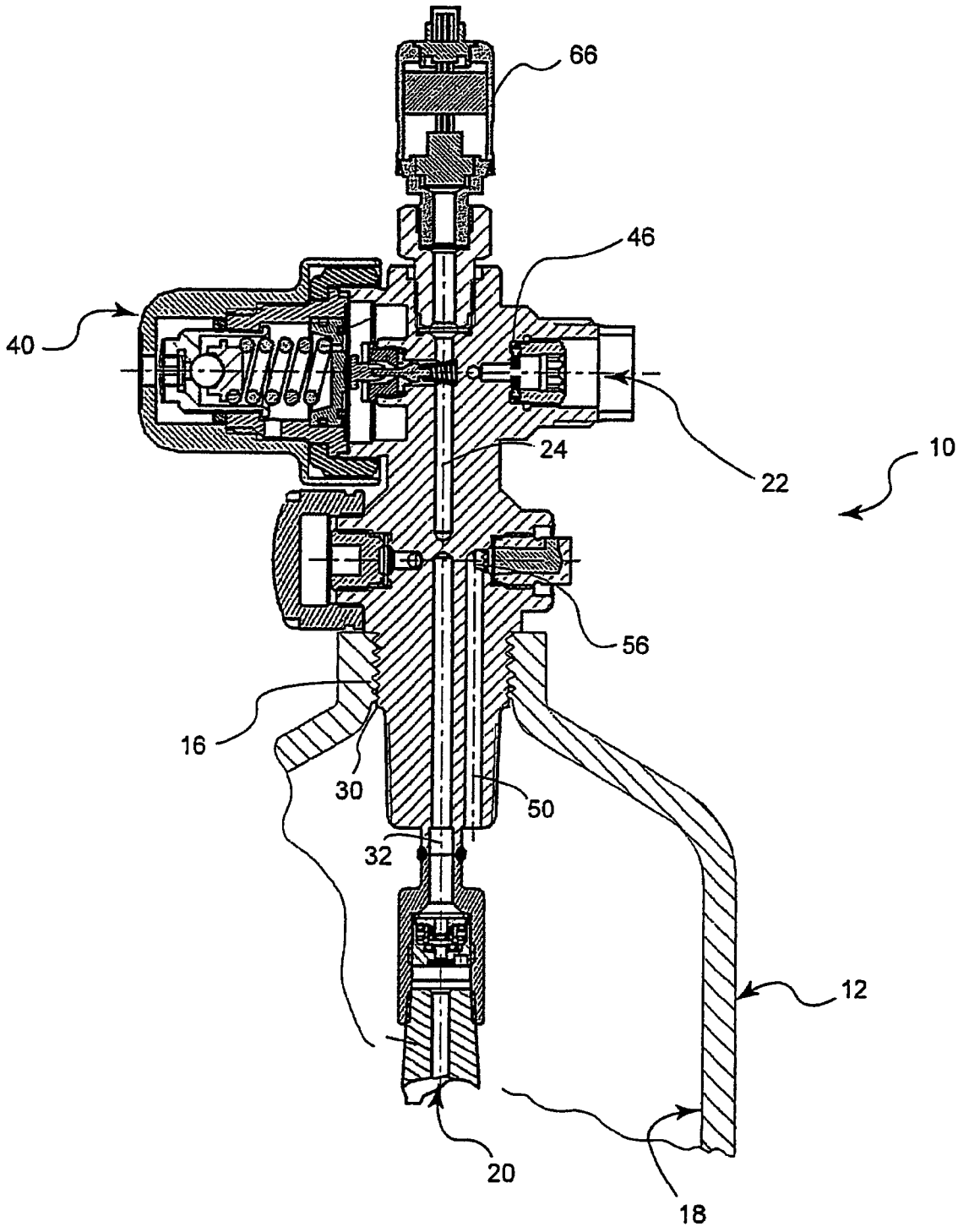
FIG. 5 is a partial axial section of a fluid control and gas delivery assembly having an integrated fluid flow restrictor for containing, receiving and storing fluids and for dispensing gas from a fluid container in accordance with an embodiment of the present invention that shows the internal arrangement in more detail.
Figure 6:
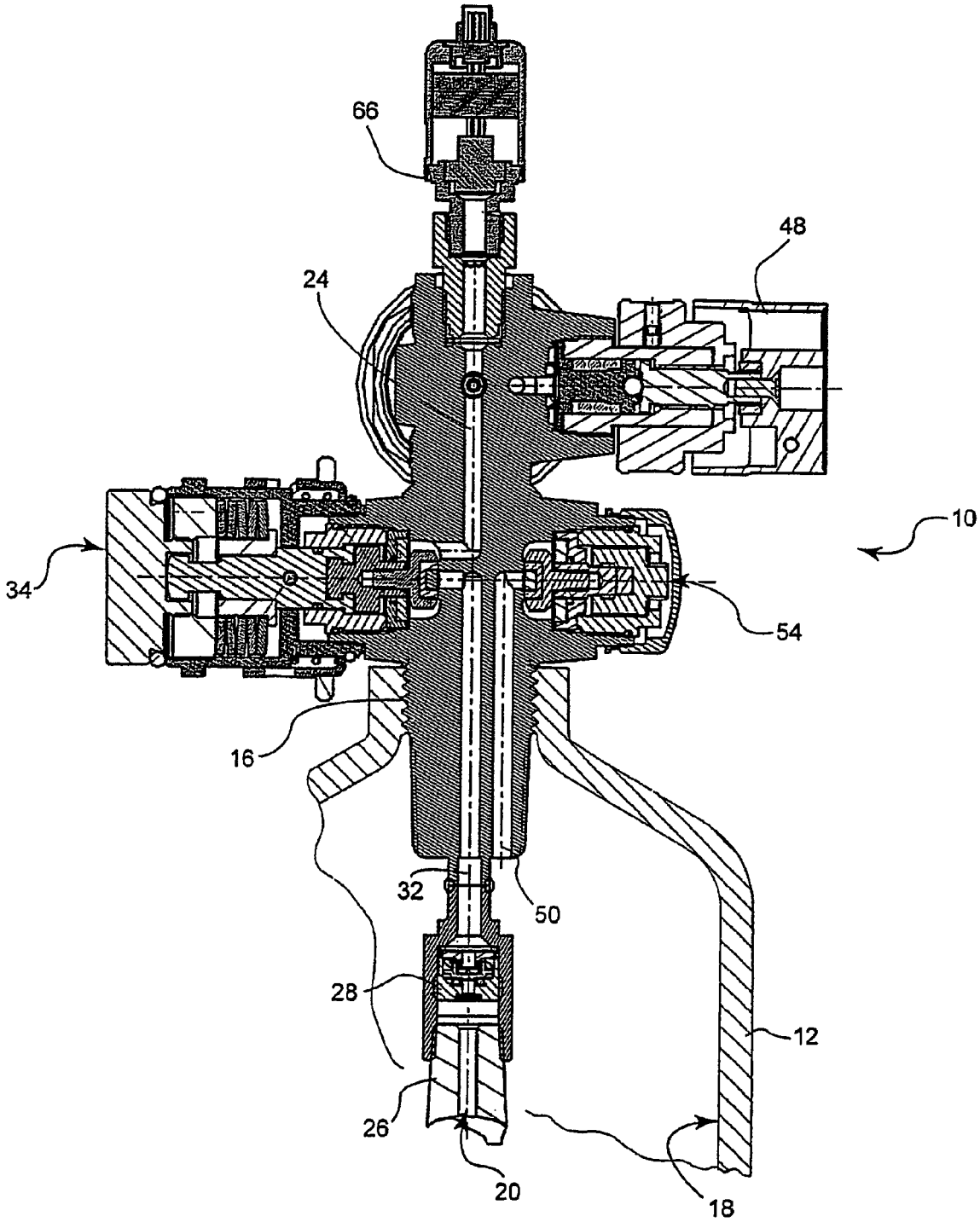
FIG. 6 is a partial axial section of a fluid control and gas delivery assembly having an integrated fluid flow restrictor for containing, receiving and storing fluids and for dispensing gas from a fluid container in accordance with an embodiment of the present invention that shows the internal arrangement in more detail from an alternate perspective.

FIGS. 5 and 6 also illustrate an embodiment of the present invention with the components of the assembly shown from a different perspective, and are partial axial sectional views of the fluid control assembly according to an embodiment of the present invention. Since FIGS. 5 and 6 have the common details indicated by the same reference numbers as the previous figures, where applicable, one of skill in the art understands the construction and operation of these features previously discussed in connection with the FIGS. 1–4.

As illustrated in FIGS. 5 and 6, another possible option is the inclusion of a pressure transducer 66 that can measure the fluid container contents whenever this valve is opened, which would take the place of the pressure measurement device normally associated with the gas panel. Additionally, each of the valves of the present invention can be coupled with local sensors that detect low ventilation, excess gas flow, toxic gas release or fire.

For added safety, a compressor (not shown) may be situated in a well-ventilated enclosure (not shown) and be interlocked with hazardous fluid release detection sensors (not shown).

An optional integral valve protection apparatus (such as to a fluid container cap, not shown) may be affixed to the fluid container 12 that allows making a low-pressure connection and actuation of the shut-off valve(s) without removing the valve protection apparatus. Additionally, with or without the above feature, the valve protection cap can optionally serve as secondary containment for vapors leaking from any threaded connections to the fluid container 12 and may optionally be fitted with a port (not shown) to attach leak detection equipment. An integral handle or other lifting aid may be molded into the valve protection apparatus to make the package more easily transported and installed.

Optionally, an electronic control system (not shown) can be adapted to the assembly 10 to provide real time control and feedback to process tools and operators with information regarding gas utilization, equipment control and operation, cylinder contents, process gas pressure and safety alarm status, for example. In a further modification of the integral valve assembly 14 (when used as a stand alone assembly or in conjunction with other modules), the integral valve assembly 14 may include other control and sensing devices, and for example, a microchip connected to a transmitter communicating with a remote control station so that switching functions within the primary module may be carried out under remote control.

The '986 patent, referred to and incorporated by reference above, discloses other safety features that are well-suited in the practice of this invention. One such safety feature is to provide a metal housing that surrounds the integral valve assembly 14 and a plastic ring fitted on the top of the housing for absorbing external impacts, protecting the connection between primary and secondary modules during handling. Also, a safety relief valve or bursting safety disc 56 (shown in FIGS. 1, 3, 4 and 5) could be included. A bursting safety disc usually is in the form of a thin, circular diaphragm made of corrosion-proof metal that is intended to break at a defined pressure.

The normal operation of the assembly 10 (not shown) when used as a stand alone assembly during a typical supply of gas from the fluid container 12 to the fluid user's application apparatus will now be described. The operation of the present invention in other configurations will be readily apparent from the description below.

In this mode of operation, the fluid user connects to the fluid delivery outlet 22, and to the user's process equipment by using the appropriate connection adapter. After connection, the purge-gas valve 60 will normally be closed, as will the fluid fill valve 52 and the safety relief valve 56. When the process gas is required, the first shut-off valve 34 will be opened. Fluid (typically gas) flows from the interior volume of the fluid container 12 and enters at the fluid delivery inlet 20. The fluid then travels from the fluid delivery inlet 20 through the purifier 26 and then through the residual pressure valve 28. Once through the residual pressure valve 40, the fluid continues along the first connection gas flow path 32 to the first shut-off valve 34. After flowing through the first shut-off valve 34 (when the first shut-off valve 34 is opened), the fluid travels along the gas dispensing path 24 to the pressure reducer 40. After passing through the pressure reducer 40 where the pressure of the fluid is reduced, the fluid travels along the gas dispensing path 24 and encounters the flow restrictor 46 and continues to a second shut-off valve 48. When the second shut-off valve 48 is opened, the fluid then passes from the assembly 10 at the fluid delivery outlet 22.

Once the fluid user has completed using the fluid, the first shut-off valve 34 is closed and the residual fluid is evacuated from the integral valve assembly 14. Before the integral valve assembly 14 of the present embodiment is disconnected from the components downstream, the second shut-off valve 48 downstream of the pressure reducer 40 is closed to prevent air from being dispensed into the evacuated space when the system is disconnected.

When the fluid container 12 has become empty or about empty, the fluid container will be disconnected at the fluid delivery outlet 22 and at the purging inlet 64 after the purge-gas valve 60 is closed. The entire unit of fluid container 12 and integral valve assembly 14 typically will then be returned to the gas supplier for filling. The filling is carried out by the gas supplier through the fluid fill inlet 54 and fill valve 52, after appropriate purging.

A new, filled, gas fluid container will be provided together with its integral valve assembly 14 (which may be a primary module, as disclosed in the '986 patent) already permanently mounted on the fluid container. The gas dispensing path 24 through the integral valve assembly 14 will be purged, and the new fluid container 12 and integral valve assembly 14 will be coupled to the user's system through the fluid delivery outlet 22 of the new gas fluid container 12 and to the purging system through the purging inlet 64.

Thus, a make and break connection will be carried out at a relatively low pressure, in the region of 0–20 bar. In most situations, the connection between the integral valve assembly 14 and the fluid container 12 is not broken by the user of the gas fluid container 12.

As should be now evident, the present invention has several advantages, which will now be discussed. One advantage of the present invention is to mitigate the effects of an unintentional release of high purity corrosive, toxic, oxidant, inert, pyrophoric fluids and mixtures of such fluids in industrial applications, including semiconductor apparatus fabrication. This invention has the advantage over conventional approaches in that the present invention is arranged to deliver substantially higher flow rates at lower fluid container pressures (i.e., as the fluid container is being depleted).

For example, a conventional RFO is sized by determining the maximum allowable mass flow release rate of the fluid and then sizing the diameter of the RFO based on the "worst case" release rate as well as the maximum fluid container pressure. In this case, the maximum possible flow through the orifice decreases as the fluid container pressure is lowered. Therefore, at lower fluid container pressures, the flow from the conventional fluid valve assembly is unnecessarily restricted to values significantly below the maximum permissible release rate. In fact, it is often necessary to place multiple fluid containers in parallel in order to maintain the desired flow rates at lower pressures.

With the present invention, however, the delivery pressure and mass flow rate can remain constant throughout most or all of the useful life of the fluid container. Since the fluid flow restrictor is configured using the pressure delivered to the fluid flow restrictor 46 by the pressure reducer 40, which is significantly less than the internal pressure of a full fluid container 12, a somewhat larger fluid flow restrictor can be used. A larger fluid flow restrictor, in turn, also reduces the risk of clogging. More significantly, the larger fluid flow restrictor and the fact that the flow capacity of the system does not steadily fall as the product is withdrawn, makes it possible to use a greater fraction of the gas within the fluid container, which reduces the user's costs. Also, the present invention allows the fluid container 12 to be filled to its maximum pressure without increasing the flow through the fluid flow restrictor 46, thereby reducing the frequency of fluid container 12 changes needed. Therefore, by increasing the fill pressure and by depleting the fluid in the fluid container 12 to a lower pressure, the user can potentially derive significantly more product from each fluid container 12.

The use of the fluid control and gas delivery assembly 10 fitted with an appropriately sized fluid flow restrictor 46 installed downstream of the pressure reducer 40 and a first shutoff valve 34 will also permit higher flow rates to be safely achieved from each fluid container 12, allowing for more process tools to be supplied from an individual fluid container 12 and/or the use of greater fill densities inside the fluid containers 12.

Moreover, as the pressure reducer 40 is a potential source of failure, the present invention positions the pressure reducer 40 between a first shutoff valve 34 and a second shutoff valve 48. This position allows for maintenance of the pressure reducer 40 without removing the assembly from the fluid container.

As a result, the present invention permits savings for the user based on reduced frequency of fluid container 12 change outs. Prudent operational practice requires trained technicians with appropriate protective equipment to conduct hazardous fluid container changes along with the associated purging steps before and afterwards. In addition to the labor savings of less-frequent fluid container changes, there is also the potential of significantly reducing costly downtime of the process equipment. Similarly, downtime caused by routine pressure reducer 40 maintenance and replacement is eliminated with these integral pressure regulated gas supply packages.

Another advantage and further safeguard incorporated into the present invention permits refill of the fluid container without making a high pressure disconnection. Normally, fluid containers contain high pressure gases that are usually controlled by a simple shutoff fluid container valve (with a rupture disc in the USA). The gas will be used usually at a pressure substantially lower than that in the container, and the user will connect in the circuit a pressure reducing device, such as an expansion valve. When there is a need to refill the gas fluid container, the shutoff valve on the fluid container is closed and the high pressure circuit is disconnected. This make and break at the high pressure of the fluid container gives the possibility of leakage and contamination. Because the pressure reducing device 40 should never be exposed to atmospheric contamination in normal operation (a separate path is used by the gas supplier to fill the fluid containers), it should now be appreciated that the maintenance requirement for the pressure reducer 40 should be lower than that for a pressure reducer on gas panels which are potentially exposed to atmospheric contamination during every fluid container change.

Another advantage of the present invention is that it provides an apparatus for containing and delivering hazardous fluids that reduces the possibility of accidental spills or release of the hazardous fluid, while at the same time, reducing capital and operating costs while enhancing the safety, reliability and quality of the delivered products. The present invention advantageously increases fluid utilization from the fluid container 12, reduces the maximum mass flow release rate from the fluid container in the event of catastrophic system failure, and incorporates multiple safeguards into a single assembly to enhance safety, efficiency, and reliability during the operation, storage and transportation of these fluids.

Having these and other advantages over the prior art, the present invention has application in a variety of industries and markets, particularly, in high flow applications. For example, the present invention may be used in connection with applications where the process gas cannot be delivered under a partial vacuum or when the pressure drop caused by the delivery system requires higher line pressure, and may include dopant, etchant, epitaxy, chamber cleaning, low-pressure chemical vapor deposition (LPCVD), plasma enhanced chemical vapor deposition (PECVD), atmospheric pressure chemical vapor deposition (APCVD), diffusion and thermal oxidation applications.

Many other modifications and combinations of the above modifications will readily occur to those skilled in the art, upon further contemplation of this specification. Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed:

1. A fluid control and gas delivery assembly for safely containing, receiving and storing hazardous fluids and for dispensing gas comprising:

a. a container having a wall separating an interior volume from a region outside said container, wherein said container is adapted for containing a fluid at a first pressure;

b. a fluid fill path extending through said wall from said region outside said container to said interior volume;

c. a gas dispensing path extending through said wall from said interior volume to said region outside said container, said gas dispensing path being non-coextensive with said fluid fill path;

d. a first shut-off valve positioned in said gas dispensing path;

e. a pressure reducer positioned in said gas dispensing path downstream of the first shut-off valve to reduce the pressure of the fluid flowing upstream of the pressure reducer to a delivery pressure;

f. a fluid flow restrictor positioned in said gas dispensing path downstream of the pressure reducer, said restrictor having a fluid flow restricting path configured to restrict the flow of the fluid delivered to the fluid flow restrictor at the delivery pressure to a maximum mass flow rate that is equal to or less than the allowable mass flow rate standard for the hazardous fluid;

g. a second shut-off valve positioned in said gas dispensing path downstream of said pressure reducer; and h. a fluid outlet connector disposed in said gas dispensing path downstream of said first and second shut-off valves and adapted for making and breaking a low-pressure connection between said gas dispensing path and apparatus for utilizing gas.

2. The fluid control and gas delivery assembly of claim 1, wherein the fluid flow restricting path is configured to limit the flow of gas delivered to the fluid flow restrictor at the delivery pressure to a mass flow rate that exceeds a maximum allowable flow rate standard at the first pressure for said fluid.

3. The fluid control and gas delivery assembly of claim 1, wherein the fluid flow restrictor comprises one or more orifices, flow nozzles, venturis, filters, screens or capillary tubes.

4. The fluid control and gas delivery assembly of claim 1, wherein the fluid flow restrictor is located in said outlet connector.

5. The fluid control and gas delivery assembly of claim 1, further comprising a residual pressure valve located in the gas dispensing path, upstream of the first shut-off valve, to prevent back flow of air or foreign fluids.

6. The fluid control and gas delivery assembly of claim 1 further comprising a purge-gas flow path having a purge gas inlet that communicates with the gas dispensing path between the first shut-off valve and the pressure reducer.

7. The fluid control and gas delivery assembly of claim 6, wherein a purge-gas valve is positioned in the purge-gas flow path to selectively open and sealingly close said purge-gas flow path.

8. The fluid control and gas delivery assembly of claim 1, further comprising a flow switch for controlling the fluid flow along the gas dispensing path.

9. The fluid control and gas delivery assembly of claim 8, further comprising a processor coupled in controlling relationship with the flow switch.

10. The fluid control and gas delivery assembly of claim 1, further comprising a purifier disposed within the container and upstream of the first shut-off valve.

11. The fluid control and gas delivery assembly of claim 1, further comprising a high pressure safety relief device upstream of the pressure reducer.

12. The fluid control and gas delivery assembly of claim 1, wherein said fluid fill path, gas dispensing path, pressure reducer, shut-off valves, fluid flow restrictor and outlet connector are defined by a primary gas control module mounted on said container.

13. The fluid control and gas delivery assembly according to claim 1, further comprising an automatic controller for operating the first shut-off valve to control the discharge of gas deriving from the fluid container.

14. The fluid control and gas delivery assembly of claim 1, wherein said hazardous fluid is selected, as required by the user's application, from the fluids consisting of: corrosive, toxic, oxidant, pyrophoric fluids and mixtures of such fluids.

15. The fluid control and gas delivery of assembly claim 1, further comprising a fluid fill valve positioned to control the flow of gas along said fluid fill path.

16. A semiconductor manufacturing system comprising a semiconductor manufacturing apparatus utilizing a gas, and a source of said gas, wherein said source comprises a fluid control and gas delivery assembly according to claim 1.

17. A method of manufacturing a Semiconductor product, comprising: containing a fluid in a confined state In a fluid control and gas delivery assembly according to claim 1; selectively dispensing the confined fluid by actuating the first shut-off valve to discharge the gas from the fluid container; and using the discharged gas in the manufacture of a semiconductor product.

18. A method for storage and dispensing of a gas, comprising: containing a gas in a confined state in a fluid control and gas delivery assembly according to claim 1; and selectively dispensing the confined gas by actuating the first shut-off valve to discharge the gas from the container.

19. A method for replacing the source of gas, in an apparatus for utilizing the gas, without breaking a high pressure connection comprising:

providing first and second Supplies of gas, each supply comprising a fluid container adapted for storing a fluid at a first pressure and having a wall separating an interior volume from a region outside said fluid container and a primary gas control module mounted on said fluid container, said module defining:

a. a gas dispensing path extending through said wall from said interior volume to said region outside said container;

b. a first shut-off valve positioned in said gas dispensing path;

c. a pressure reducer positioned in said gas dispensing path downstream of the first shut-off valve to reduce the pressure of the fluid flowing upstream of the pressure reducer to a delivery pressure;

d. a fluid flow restrictor positioned in said gas dispensing path downstream of the pressure reducer and upstream of an outlet, said restrictor having a fluid flow restricting path configured to restrict the flow of the fluid delivered to the fluid flow restrictor at the delivery pressure to a maximum mass flow rate that is equal to or less than the maximum allowable mass flow rate standard for the hazardous fluid;

e. a second shut-off valve positioned in said gas dispensing path downstream of said pressure reducer; and f. an outlet connector disposed in said gas dispensing path downstream of said first and second shut-off valves and adapted for making and breaking a low-pressure connection between said gas dispensing path and apparatus for utilizing gas;

providing apparatus for using the gas, said apparatus having a low-pressure inlet and an inlet connector, said inlet connector initially being coupled to the outlet connector of said first supply of gas to Supply gas from said first supply to said apparatus;

closing the shut-off valve of said first supply of gas to isolate said first supply of gas from said apparatus for using the gas;

breaking the low-pressure connection between the connectors of said first supply of gas and said apparatus for using the gas;

replacing said first supply of gas with said second supply of gas;

while the shut-off valve of said second supply of gas is closed, making a low-pressure connection between the connectors of said second supply of gas and said apparatus for using the gas; and opening the shut-off valve of said second supply of gas, allowing gas to flow from said second supply to Said apparatus for using the gas.

20. The method of claim 19, further comprising refilling said first supply of gas via said fluid fill path.

21. The method of claim 19 wherein said apparatus for using the gas comprises a tool for manufacturing an integrated circuit.

* * * * *